US005881407A

United States Patent [19]

Chu Pt

[11] Patent Number: 5,881,407

[45] Date of Patent: Mar. 16, 1999

[54] MULTIPLE CHAMBER SEQUENTIAL INFLATION SEAT CUSHION

[76] Inventor: Shyuan Chu Pt, 800 Hampton Rd., Arcadia, Calif. 91006

[21] Appl. No.: 63,219

[22] Filed: Apr. 20, 1998

[51] Int. Cl.[6] ..... A47C 27/10; A63G 7/057

[52] U.S. Cl. ..... 5/654; 297/452.41; 601/149

[58] Field of Search ..... 5/654, 713, 710, 5/655.3; 297/452.41, 284.6; 601/148, 149

[56] References Cited

U.S. PATENT DOCUMENTS

| | | | |
|---|---|---|---|
| 1,772,310 | 8/1930 | Hart | 5/713 |
| 3,008,465 | 4/1961 | Gal | 601/149 |
| 3,297,023 | 1/1967 | Foley | 5/654 |
| 4,840,425 | 6/1989 | Noble | 297/284.1 |
| 4,852,195 | 8/1989 | Schulman | 5/713 |
| 5,029,939 | 7/1991 | Smith et al. | 5/654 |
| 5,379,471 | 1/1995 | Holdredge | 5/654 |

*Primary Examiner*—Alex Grosz
*Attorney, Agent, or Firm*—Goldstein & Canino

[57] ABSTRACT

A seat cushion inflation system, for periodically shifting the body weight / of a person seated on the cushion. The seat cushion comprises four inflation chambers which are separately inflatable. An inflation cycle is a sequence of inflations and deflations whereby the chambers are inflated alone and in combination with other chambers, and then are deflated, with a time delay between every step.

8 Claims, 4 Drawing Sheets

MULTIPLE CHAMBER SEQUENTIAL INFLATION SEAT CUSHION

BACKGROUND OF THE INVENTION

The invention relates to a multiple chamber sequential inflation seat cushion. More particularly, the invention relates to a seat cushion having multiple inflatable chambers, which are selectively inflated and deflated sequentially in a predetermined order.

Even the most comfortable chair can become uncomfortable if one sits in it long enough. The pressure of the chair upon the buttocks and upper thighs has a tendency to cut-off circulation and cause discomfort.

When most people become uncomfortable from sitting too long, they will stand up, and allow the blood to circulate in their upper thighs and buttocks. Many people, such as those suffering from disabilities, do not have the ability to get out of their chair. In particular, people bound to wheelchairs and the like are forced to deal with the daily discomfort caused by prolonged sitting.

Several devices have been proposed which seek to deal with the discomfort associated with prolonged sitting by providing inflatable areas within the seat. U.S. Pat. No. 4,840,425 to Noble discloses an automotive seat which contains a plurality of inflation chambers which are sequentially inflated from the front of the seat toward the back. U.S. Pat. No. 5,379,471 to Holdredge discloses a pneumatic wheelchair cushion which has a plurality of air sacks which are sequentially deflated for a preferred period of twelve seconds per minute by a rotating air distributor.

While these units may be suitable for the particular purpose employed, or for general use, they would not be as suitable for the purposes of the present invention as disclosed hereafter.

SUMMARY OF THE INVENTION

It is an object of the invention to produce a seat cushion which reduces fatigue from prolonged sitting. Accordingly, the seat cushion has a plurality of chambers which are selectively inflated to alleviate pressure on certain areas of the body.

It is another object of the invention to provide a seat cushion which shifts the body weight distribution of a person seated thereon to reduce the pressure of the body from sitting in one position for too long. Accordingly, inflation of the seat cushion chambers is carefully controlled in order to change the body weight distribution just as it is needed to alleviate fatigue.

It is a further object of the invention to provide a seat cushion which shifts the body weight at meaningful intervals, to effectively combat fatigue. Accordingly, an inflation cycle is described herein which is carefully selected with inflation sequences and inflation times to help increase blood flow and circulation by producing involuntary muscular activity.

The invention is a seat cushion inflation system, for periodically shifting the body weight of a person seated on the cushion. The seat cushion comprises four inflation chambers which are separately inflatable. An inflation cycle is a sequence of inflations and deflations whereby the chambers are inflated alone and in combination with other chambers, and then are deflated, with a time delay between every step.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
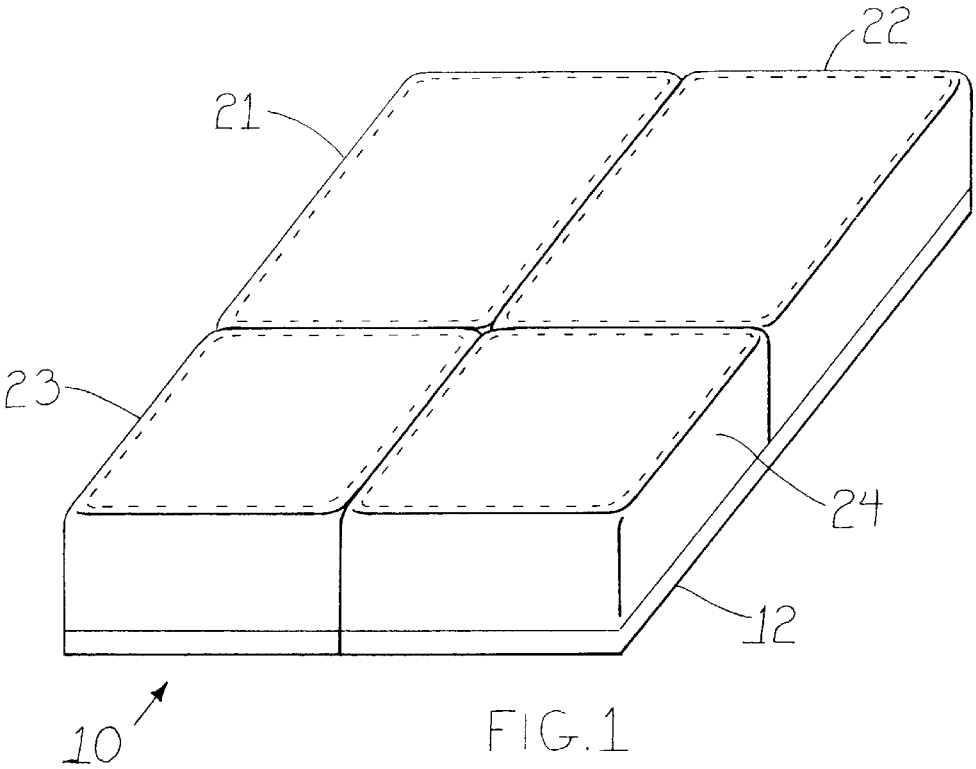
FIG. 1 is a diagrammatic perspective view of the seat cushion, wherein all four chambers are fully inflated.

FIG. 1 illustrates a seat cushion 10 comprising a base 12 and four inflation chambers mounted thereupon. The inflation chambers form quadrants, and include a first chamber 21, a second chamber 22, a third chamber 23, and a fourth chamber 24. The first chamber 21 and fourth chamber 24 are each adjacent to the second chamber 22 and third chamber 23, but the first chamber 21 and fourth chamber 24 are not adjacent to each other. The first chamber 21 and second chamber 22 are generally larger in surface area than the third chamber 23 and fourth chamber 24. In FIG. 1, all four chambers are illustrated fully inflated, which never actually occurs in the inflation cycle that will be disclosed hereinafter.

Figure 2:
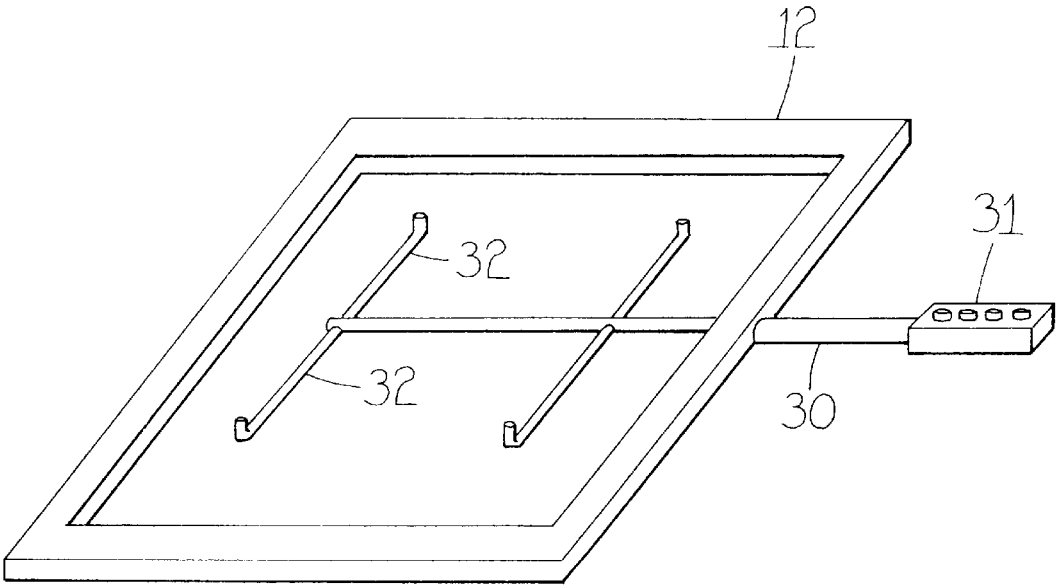
FIG. 2 is a diagrammatic perspective view, illustrating the air distribution system according to the present invention.

In FIG. 2, the chambers have been removed from the base 12, revealing an air distribution system 30 which controls air flow to the four inflation chambers. The air distribution system 30, includes a valve assembly 31 and a plurality of conduits 32 which extend within the base 12, to separately and selectively provide inflation pressure to the four chambers.

FIG. 3 through FIG. 7 illustrate an inflation cycle, wherein various chambers are inflated, maintained in an inflated state for a period of time, and then are deflated and maintained in a deflated state for another period of time.

Figure 3:
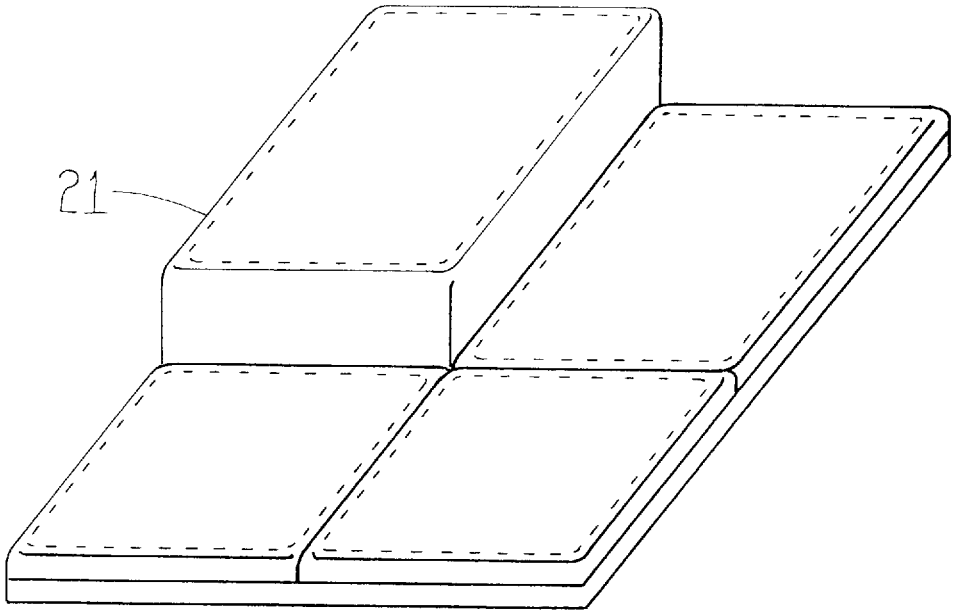
FIG. 3 is a diagrammatic perspective view, illustrating a first inflation step of the inflation cycle, wherein the first chamber is inflated.

FIG. 3 illustrates a first inflation step in the inflation cycle, wherein the first chamber 21 has been inflated. Once fully inflated, the first chamber 21 is maintained in an inflated state for a period of fifteen minutes. Then, the first chamber 21 is deflated, and the cushion 10 remains flat for a period of twenty minutes prior to initiation of a second inflation step.

Figure 4:
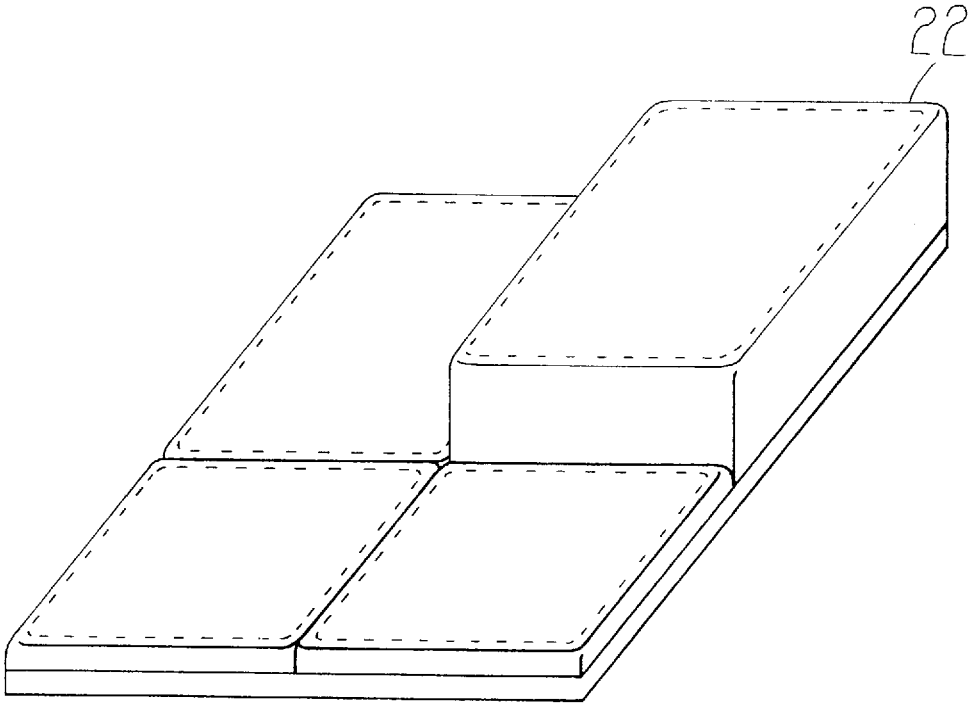
FIG. 4 is a diagrammatic perspective view, illustrating a second inflation step of the inflation cycle, wherein the second chamber is inflated.

FIG. 4 illustrates the second inflation step in the inflation cycle, wherein the second chamber 22 has been inflated, Once fully inflated, second chamber 22 is maintained in an inflated state for a period of fifteen minutes. Then, the second chamber 22 is deflated, and the cushion 10 remains flat for a period of twenty minutes prior to initiation of a third inflation step.

Figure 5:
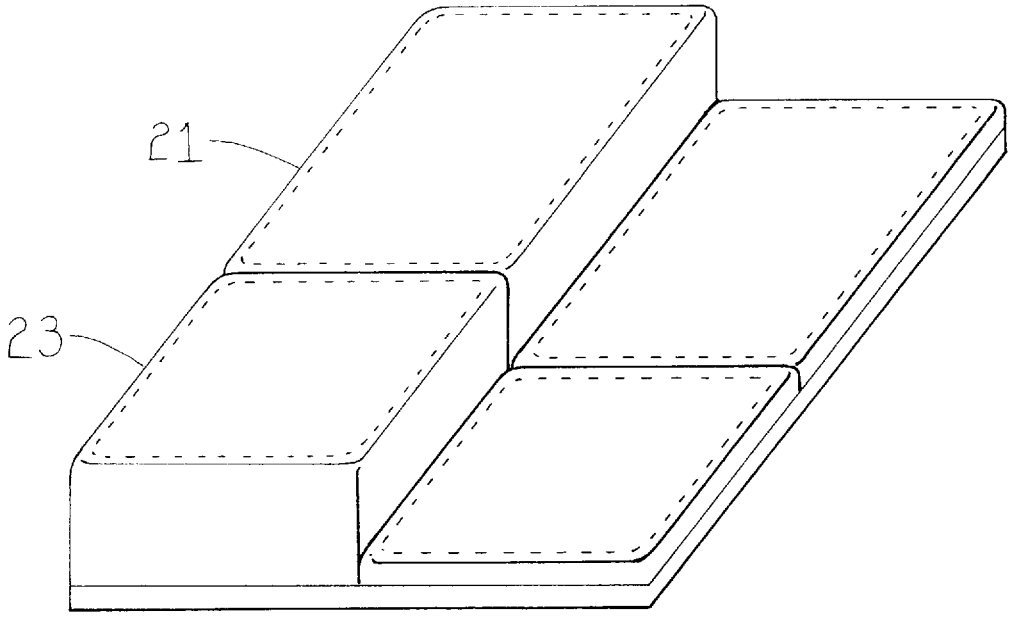
FIG. 5 is a diagrammatic perspective view, illustrating a third inflation step of the inflation cycle, wherein the first and third chambers are inflated.

FIG. 5 illustrates the third inflation step in the inflation cycle, wherein the first chamber 21 and third chamber 23 have been inflated, Once fully inflated, the first chamber 21 and third chamber 23 are maintained in an inflated state for a period of ten minutes. Then, the first chamber 21 and third chamber 23 are deflated, and the cushion 10 remains flat for a period of fifteen minutes prior to initiation of a fourth inflation step.

Figure 6:
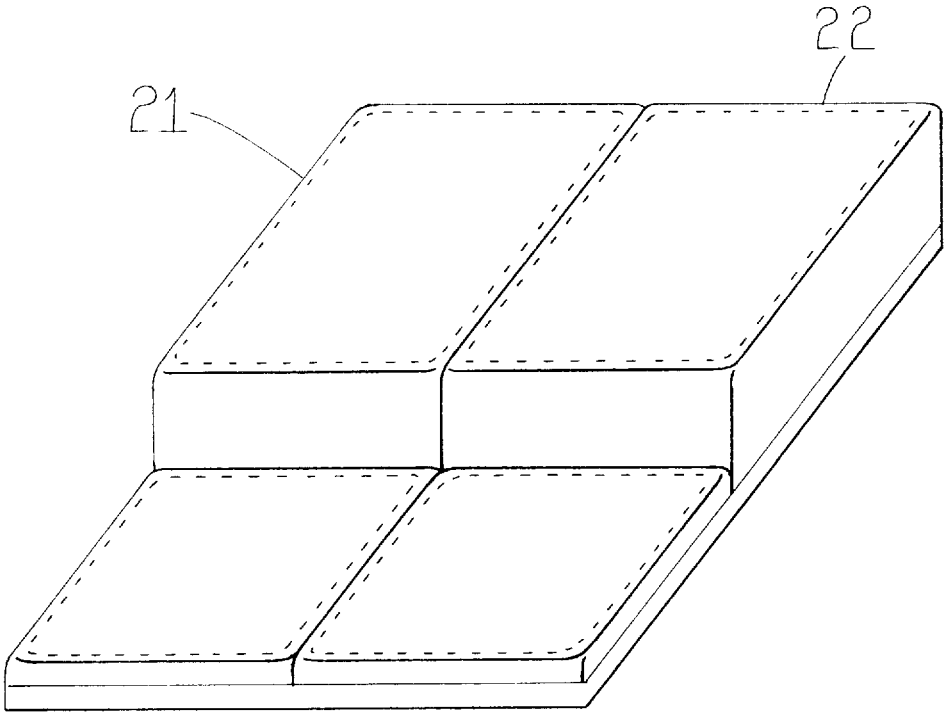
FIG. 6 is a diagrammatic perspective view illustrating a fourth inflation step of the inflation cycle, wherein the first and second chambers are inflated.

FIG. 6 illustrates the fourth inflation step in the inflation cycle, wherein the first chamber 21 and second chamber 22 have been inflated, Once fully inflated, the first chamber 21 and second chamber 22 are maintained in an inflated state for a period of twenty minutes. Then, the first chamber 21 and second chamber 22 are deflated, and the cushion 10 remains flat for a period of twenty minutes prior to initiation of a fifth inflation step.

Figure 7:
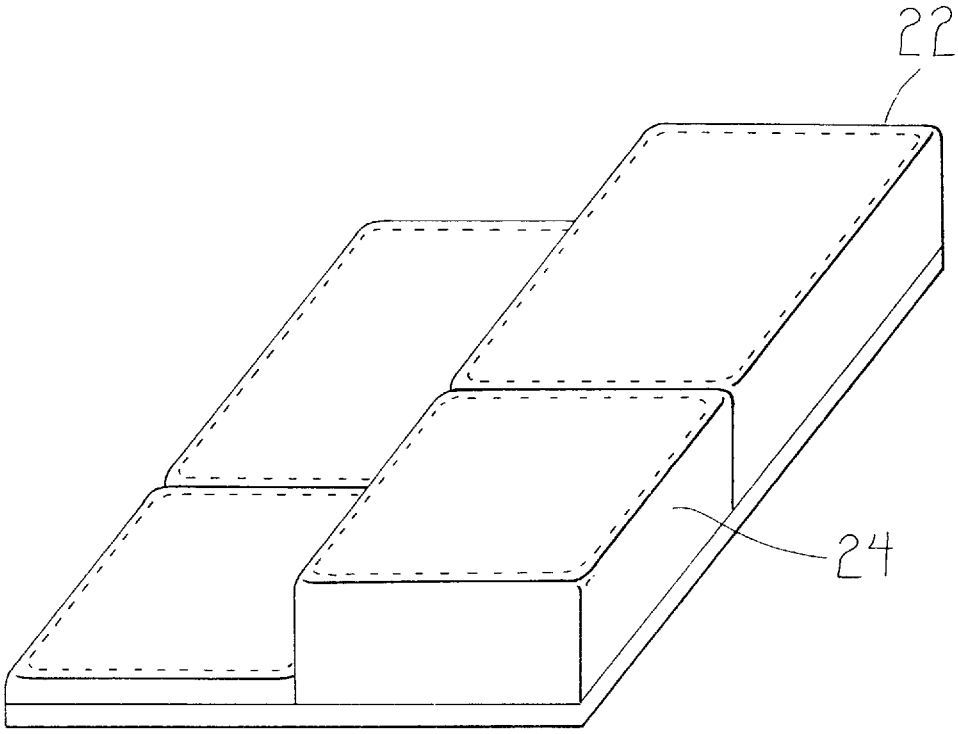
FIG. 7 is a diagrammatic perspective view, illustrating a fifth inflation step of the inflation cycle, wherein the second and fourth chambers are inflated.

FIG. 7 illustrates the fifth inflation step in the inflation cycle, wherein the second chamber 22 and fourth chamber 24 have been inflated, Once fully inflated, the second chamber 22 and fourth chamber 24 are maintained in an inflated state for a period of twenty minutes. Then, the second chamber 22 and fourth chamber 24 are deflated, and the cushion 10 remains flat for a period of twenty minutes prior to completion of the inflation cycle.

Once the inflation cycle has been completed, by performing inflation steps one through five, the cycle is reiniated, beginning again with step one.

In conclusion, herein is presented a seat cushion which has a plurality of inflatable chambers which are separately inflated according to an inflation cycle which is performed in a sequence and timed inorder to shift the stress points and body weight distribution of a person seated on the cushion, and reduce fatigue associated with prolonged sitting.

What is claimed is:

1. A seat cushion inflation method, for periodically changing body weight distribution to a person seated upon a seat cushion, the seat cushion having four chambers that are separately inflatable, comprising the steps of:

a) inflating one of the chambers;

b) maintaining said chamber in an inflated state for a predetermined period;

c) deflating said chamber;

d) maintaining said cushion in a deflated state for a second predetermined period; and e) repeating steps a) through d) with another one of the chambers until all of the chambers have been inflated; then f) repeating step e).

2. A seat cushion inflation method, for periodically changing body weight distribution to a person seated upon a seat cushion, the seat cushion having a first chamber, second chamber, third chamber, and fourth chamber that are each separately inflatable, comprising the steps of:

a) inflating the first chamber;

b) deflating the first chamber;

c) inflating the second chamber;

d) deflating the second chamber;

e) inflating the first chamber and third chamber;

f) deflating the first chamber and third chamber;

g) inflating the first chamber and second chamber;

h) deflating the first chamber and second chamber;

i) inflating the second chamber and fourth chamber; and j) deflating the second chamber and fourth chamber; and k) repeating step a) through j).

3. The seat cushion inflation method as recited in claim 2, wherein each of said steps is separated by a time delay of between ten and twenty minutes.

4. The seat cushion inflation method as recited in claim 3, wherein step a) is followed by a fifteen minute delay and step b) is followed by a twenty minute delay.

5. The seat cushion inflation method as recited in claim 4, wherein step c) is followed by a fifteen minute delay, and step d) is followed by a twenty minute delay.

6. The seat cushion inflation method as recited in claim 5, wherein step e) is followed by a ten minute delay, and step f) is followed by a fifteen minute delay.

7. The seat cushion inflation method as recited in claim 6, wherein step g) is followed by a twenty minute delay, and step h) is followed by a twenty minute delay.

8. The seat cushion inflation method as recited in claim 7, wherein step i) is followed by a fifteen minute delay, and step j) is followed by a twenty minute delay.

* * * * *